US006181988B1

(12) United States Patent
Schneider et al.

(10) Patent No.: US 6,181,988 B1
(45) Date of Patent: Jan. 30, 2001

(54) GUIDANCE SYSTEM HAVING A BODY FIXED SEEKER WITH AN ADJUSTABLE LOOK ANGLE

(75) Inventors: Arthur J. Schneider; Guy B. Coleman, both of Tucson, AZ (US)

(73) Assignee: Raytheon Company, Lexington, MA (US)

( * ) Notice: Under 35 U.S.C. 154(b), the term of this patent shall be extended for 0 days.

(21) Appl. No.: 09/056,490

(22) Filed: Apr. 7, 1998

(51) Int. Cl.[7] ..... G05B 1/00
(52) U.S. Cl. ..... 701/3; 244/3.16
(58) Field of Search ..... 701/1, 3, 4; 244/3.14, 244/3.15, 3.16

(56) References Cited

U.S. PATENT DOCUMENTS

| | | | | |
|---|---|---|---|---|
| 4,087,061 | * | 5/1978 | Burt | 244/3.16 |
| 4,520,973 | * | 6/1985 | Clark et al. | 244/3.16 |
| 4,690,351 | * | 9/1987 | Beckerleg et al. | 244/3.16 |
| 4,738,412 | * | 4/1988 | Ozunas | 244/3.21 |
| 5,125,595 | * | 6/1992 | Helton | 244/3.16 |
| 5,201,895 | * | 4/1993 | Grosso | 244/3.16 |
| 5,323,987 | * | 6/1994 | Pinson | 244/3.16 |

* cited by examiner

*Primary Examiner*—William A. Cuchlinski, Jr.
*Assistant Examiner*—Eric Gibson
(74) *Attorney, Agent, or Firm*—David W. Collins; Andrew J. Rudd; Glenn H. Lenzen, Jr.

(57) ABSTRACT

A missile guidance system with a fixed body missile seeker having an adjustable look angle. The missile seeker has a fixed camera whose look angle is adjustable to keep a moving target within the field of view of the camera. The target is tracked by a tracker to generate target angle and line of sight rate signals. The target angle signal is input to pointing angle adjustment apparatus which adjusts the look angle of the camera. The pointing angle adjustment apparatus may comprise a stepper motor that controls the angular position of a gimbal on which the camera is mounted. Alternatively, the pointing angle adjustment apparatus may comprise one or more stepper motors that control an adjustable zoom lens or a plurality of optical wedges, respectively. A body angular rate output signal of a body-fixed inertial measurement system is summed with the line of sight rate signals from the tracker to determine the inertial line of sight rate of the moving target. The inertial line of sight rate is driven to zero or a low fixed value by a control system to accurately track a target. The control system and missile dynamics generate a body angle signal that is input to a difference circuit along with a camera pointing angle signal output by the pointing angle adjustment apparatus. The difference circuit generates a desired camera pointing angle that is input to the pointing angle adjustment apparatus to point the camera at the target.

4 Claims, 1 Drawing Sheet

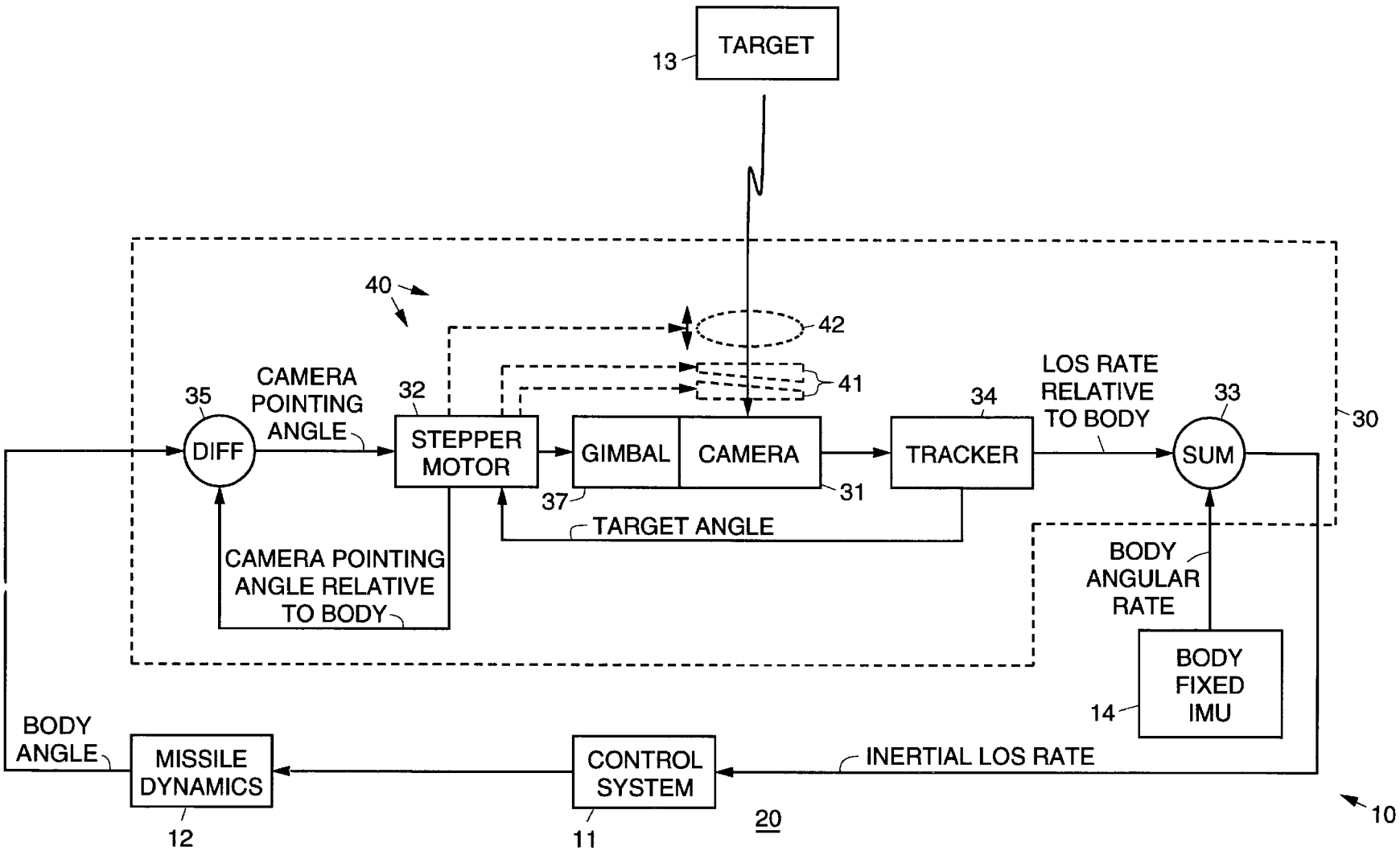
10
30
33
SUM
BODY FIXED IMU
14
BODY ANGULAR RATE
LOS RATE RELATIVE TO BODY
34
TRACKER
INERTIAL LOS RATE
TARGET
13
42
41
31
CAMERA
GIMBAL
37
TARGET ANGLE
20
CONTROL SYSTEM
11
STEPPER MOTOR
32
40
CAMERA POINTING ANGLE
CAMERA POINTING ANGLE RELATIVE TO BODY
35
DIFF
MISSILE DYNAMICS
12
BODY ANGLE

GUIDANCE SYSTEM HAVING A BODY FIXED SEEKER WITH AN ADJUSTABLE LOOK ANGLE

BACKGROUND

The present invention relates generally to missile guidance systems, and more particularly, to a missile guidance system employing a fixed missile seeker having an adjustable look angle.

Conventional missile seekers employ a gimbal system that typically includes rate gyros, resolvers, torquers, bearings, and a support structure therefor. Infrared or visible television cameras have heretofore been used on missiles for the purpose of implementing a missile seeker to provide missile guidance.

However, simply fixing the camera to the missile forces a compromise between field of view and resolution because cameras typically have a fixed number of image pixels in azimuth and elevation. Using pursuit guidance against moving targets is usually not satisfactory because of the high lateral acceleration required as the missile closes on the target. Proportional guidance requires an offset look angle relative to the velocity vector of the missile to account for the velocity of the target. Accommodating this look angle requirement by enlarging the field of view usually increases the pixel size to the point where resolution does not define the target adequately for tracking purposes. Consequently, prior art attempts to use fixed television cameras in missile seekers has not been successful.

Accordingly, it is an objective of the present invention to provide for a missile guidance system employing a fixed missile seeker having an adjustable look angle that overcomes the limitations of and improve upon prior art missile seeker designs.

SUMMARY OF THE INVENTION

To meet the above and other objectives, the present invention provides for an improved missile guidance system employing a missile seeker having a fixed body (i.e., a body that is fixed relative to the missile) that has an adjustable look angle. The missile seeker comprises an infrared or visible television camera that is fixed to the body of the missile that has adjustable look or viewing angle, which is changed to keep a target within and generally centered in the field of view of the camera. The video output of the camera is processed by a tracker to generate target angle and line of sight rate signals. The target angle signal is input to pointing angle adjustment apparatus that is used to adjust the look angle of the camera.

In one embodiment, the pointing angle adjustment apparatus comprises a stepper motor which is used to control the angular position of a gimbal on which the camera is mounted to control the pointing angle of the camera. Alternatively, the pointing angle adjustment apparatus may comprise one or more stepper motors that control an adjustable zoom lens or a plurality of optical wedges, respectively, that replace the gimbal. These alternative embodiments are less costly than implementing the gimbaled camera embodiment.

A body angular rate output signal of a body-fixed inertial measurement system having a built-in rate gyro is summed with the line of sight rate signals from the tracker to determine the inertial line of sight rate of the moving target. The inertial line of sight rate is driven to zero or a low value by a control system in order to accurately track a target. The control system and missile dynamics of the missile are employed to generate a body angle signal. The body angle signal is input to a difference circuit along with the camera pointing angle signal output by the pointing angle adjustment apparatus to generate a desired camera pointing angle that is input to the pointing angle adjustment apparatus to point the camera in the desired pointing direction.

The present invention eliminates the use of a gimbal system that is conventionally used as part of the missile seeker, and thus significantly reduces the cost of the missile seeker by eliminating rate gyros, resolvers, torquers, structure, and bearings. The measured line of sight rates are driven to zero or a low fixed value depending on the selected guidance law used by the seeker.

The present invention uses inexpensive and reliable stepper motors to point the camera at approximately the desired angle, while keeping the target within the field of view dictated by resolution requirements. The stepper motor has a number of fixed stopping points within and beyond the field of view, and they are selected to keep the target within the field of view. In general, the line of sight rate of the moving target is measured using the output from the camera and the body-fixed inertial measurement system, and the line of sight rate driven to zero.

When the stepper motor moves from one fixed angle to the next one, the target is temporarily lost. However, a target tracker on the missile is used to reacquire the target. This is not difficult because the step size is known and tracking processes employed in the tracker easily reacquires the target.

The present system reduces the cost of the seeker while keeping the field of view small enough to provide the resolution required by the tracker. However, the present invention is limited in the degree of target acceleration that can be processed. Never the less, the present system may be readily used against tank and helicopter targets, for example, or other targets that have reasonable line of sight rates.

BRIEF DESCRIPTION OF THE DRAWINGS

The various features and advantages of the present invention may be more readily understood with reference to the following detailed description taken in conjunction with the accompanying drawing, which is a functional block diagram illustrating a guidance system employing a seeker in accordance with the principles of the present invention.

DETAILED DESCRIPTION

Referring to the sole drawing FIGURE, it is a functional block diagram showing exemplary missile guidance systems 10 in accordance with the principles of the present invention for use in a missile 20. The missile guidance system 10 comprises a seeker 30, a body fixed inertial measurement unit (IMU) 14 that outputs an angular rate signal indicative of the angular rate of the body of the missile 20, a control system 11 for steering (controlling the flight of) the missile 20, and missile dynamics 12 which comprise subsystems of the missile 20 used to steer the missile 20 toward a moving target 13.

The control system 11 processes an inertial line of site (LOS) rate signal that is output by the seeker 30 to produce control signals that control the flight of the missile 20. The missile dynamics 12 receives the control signals from the control system 11 and steers the missile 20 toward the target 13. The missile dynamics 12 outputs a signal indicative of the body angle of the missile 20 which is input to the seeker 30.

The seeker 30 comprises a camera 31 that is fixed relative to the body of the missile 20 (i.e., fixed relative to the velocity vector of the missile). The camera 31 has an adjustable pointing (look) angle that is adjusted using pointing angle adjustment apparatus 40, such as a gimbal 37, for example, whose pointing direction is controlled by a stepper motor 32. The pointing angle of the camera 31 has a predetermined number of fixed angular pointing directions that are set by controlling the pointing angle adjustment apparatus 40. For example, the stepper motor 32 may be controlled to step to any desired setting which in turn rotates the gimbal 37 to point the camera 31 in a direction set by the stepper motor 32.

The camera 31 is coupled to a target tracker 34 that processes video output signals therefrom to track the moving target 13. The target tracker 34 processes the video output signals from the camera 31 to determine the line of sight rate of the moving target 13 relative to the body of the missile 20. The line of sight rate output signal of the tracker 34 is input to a first input of a summing device 33. The angular rate signal output by the body fixed inertial management system 14 is input to a second input of the summing device 33. The angular rate signal and the line of sight rate output signal are summed in the summing device 33 to produce an inertial line of sight (LOS) rate signal that is input to the control system 11.

The target tracker 34 also generates a target angle output signal that is the difference between the pointing angle to the target 13 from the camera 31 and the body angle (velocity vector) of the missile 20. The target angle output signal is input to the stepper motor 32 (the pointing angle adjustment apparatus 40). The stepper motor 32 generates a camera pointing angle output signal in response to the target angle output signal that is indicative of the pointing angle to the target 13 relative to the body of the missile 20. The camera pointing angle output signal from the stepper motor 32 is input to a first input of a difference circuit 35. The body angle output signal derived from the missile dynamics 12 is input to a second input of the difference circuit 35. The difference circuit 35 subtracts the camera pointing angle output signal from the body angle output signal to generate a camera pointing angle signal indicative of the desired pointing angle to the target 13 which is input to the stepper motor 32 and which causes the stepper motor 32 to step the gimbal 37 to a new pointing direction. The stepper motor 32 thus adjusts the pointing angle of the camera 31 in response to the camera pointing angle signal from the difference circuit 35. The stepper motor 32 changes the pointing angle of the gimbal 37, and hence the pointing angle of the camera 31 to one of the predetermined pointing angles determined by the stepper motor 32.

The drawing FIGURE illustrates how the inertial line of sight rate of the moving target 13 that is imaged by the seeker 30 and tracked by the tracker 34 is measured by the guidance system 10. The seeker 30 is used to measure the line of sight rate of the moving target 13 relative to the direction of motion (the velocity vector) of the missile 20. The control system 11 is used to drive the difference between the line of sight rate of the moving target 13 and the line of sight rate of the missile 20 to zero or a low fixed value in order to accurately track the target 30.

The body-fixed inertial measurement system 14 comprises rate gyros that output signals that are indicative of the angular rate of the body of the missile 20. The body angular rate signals are summed in the summing circuit 33 with the line of sight rate output signals from the tracker 34. This produces the inertial line of sight rate signals which are driven to zero (or a low fixed value) by the control system 11 depending on the selected guidance law used in the control system 11 to guide the missile 20.

As was generally described above, the first embodiment of the seeker 30 comprises a single gimbal 37 driven by the stepper motor 32, and may comprise a body fixed focal plane array as the camera 31. Such a seeker 30 may be use to target tanks, ground vehicles, and helicopters, for example. In such an infrared seeker 30, the look angle typically does not exceed 10 degrees for a helicopter flying at 110 feet per second, for example. In other designs, two gimbals 37 driven by two stepper motors 32 may be used.

An alternative arrangement for adjusting the look angle of the camera 31 is to employ two rotatable optical wedges 41 (shown with dashed lines in the drawing FIGURE) that are respectively driven by two stepper motors 32 (but illustrated in the drawing FIGURE by only one stepper motor 32). The rotatable optical wedges 41 are disposed between the camera 31 and object space. The camera 31 is fixed to the body of the missile 20, and the look angle is adjusted in two dimensions by adjusting the respective rotational angles of the two rotatable optical wedges 41.

Another alternative arrangement for adjusting the look angle of the camera 31 is to employ a zoom lens 42 driven by a stepper motor 32 that adjusts the zoom lens 42 to stop at selected fields of view (illustrated by the double-headed vertical arrow adjacent to the lens 42 in the drawing FIGURE). In this embodiment, the camera 31 is coaxially aligned along an axis of the missile 20. The look angle limit is the edge of the field of view of the camera 31.

The advantages of the present guidance systems 10 are that they measure inertial line of sight rate, enable proportional guidance, eliminate expensive rate gyros used on gimbal stabilized seekers, eliminate torquers and powerful servo drives, and eliminate resolvers or other gimbal angle pickoffs typically used in conventional missile seekers. The use of a body-fixed focal plane array as the camera 31 enables steady state cryoengine or thermoelectric cooling of the focal plane array by mechanical coupling it to a heat sink. Steady state cooling eliminates delay derived from cooling the detector array after the target 13 has been seen by an external target acquisition system (which is usually a forward looking infrared system attached to the launcher). Steady state cooling also enables the missile seeker 30 to function as a target acquisition system (containing both the camera 31 and the tracker 34) as is depicted in the drawing FIGURE.

Thus, missile seekers having a fixed body and an adjustable look angle have been disclosed. It is to be understood that the described embodiments are merely illustrative of some of the many specific embodiments which represent applications of the principles of the present invention. Clearly, numerous and other arrangements can be readily devised by those skilled in the art without departing from the scope of the invention.

What is claimed is:

1. A missile guidance system for guiding a missile toward a moving target, said guidance system comprising:

a body fixed inertial measurement system disposed on the missile that outputs an angular rate signal indicative of the angular rate of the body of the missile;

a control system that processes an inertial line of sight rate signal to produce control signals that control the flight of the missile;

missile dynamics for processing the control signals from the control system to steer the missile toward the moving target and for generating a body angle output signal indicative of the body angle of the missile; and a seeker comprising:

a camera that is fixed relative to the body of the missile and that has an adjustable pointing angle;

a target tracker coupled to the camera that processes video output signals therefrom to track the moving target, for generating a line of sight rate output signal indicative of the line of sight rate of the target relative to the body of the missile, and for generating a target angle output signal that is the difference between the pointing angle of the camera and the body angle of the missile that is input to the pointing angle adjustment apparatus;

pointing angle adjustment apparatus for controlling the pointing direction of the camera to have a predetermined number of fixed settings that define predetermined pointing directions of the camera, and wherein the pointing angle adjustment apparatus generates a camera pointing angle output signal that is indicative of the camera pointing angle to the target relative to the body of the missile;

a summing device having a first input for receiving the line of sight rate output signal from the tracker and a second input for receiving the angular rate signal output by the body fixed inertial measurement system, and for summing the signals to produce an inertial line of sight rate signal;

a difference circuit having a first input for receiving the camera pointing angle output signal and having a second input for receiving the body angle output signal, for generating a camera pointing angle signal indicative of the desired pointing angle of the camera;

and wherein the camera pointing angle signal is input to the pointing angle adjustment apparatus which adjusts the pointing angle of the camera to a selected one of the predetermined pointing angles that points the camera at the moving target.

2. The guidance system of claim 1 wherein the pointing angle adjustment apparatus comprises a stepper motor that is coupled to a gimbal.

3. The guidance system of claim 1 wherein the pointing angle adjustment apparatus comprises two stepper motors that are respectively coupled to two rotatable optical wedges.

4. The guidance system of claim 1 wherein the pointing angle adjustment apparatus comprises a stepper motor that is coupled to a zoom lens that is adjustable to stop at selected fields of view under control of the stepper motor.

* * * * *